US006241419B1

(12) United States Patent
Bond

(10) Patent No.: US 6,241,419 B1
(45) Date of Patent: Jun. 5, 2001

(54) SPEED SENSITIVE AUTOMATIC SPEED BUMP

(76) Inventor: Michael L. Bond, 3530 Harmony Cove, Lilburn, GA (US) 30047

( * ) Notice: Subject to any disclaimer, the term of this patent is extended or adjusted under 35 U.S.C. 154(b) by 0 days.

(21) Appl. No.: 09/413,097

(22) Filed: Oct. 7, 1999

Related U.S. Application Data

(60) Provisional application No. 60/107,029, filed on Nov. 4, 1998, provisional application No. 60/118,079, filed on Jan. 29, 1999, provisional application No. 60/126,466, filed on Mar. 26, 1999, and provisional application No. 60/126,912, filed on Mar. 29, 1999.

(51) Int. Cl.[7] ..... E01F 11/00

(52) U.S. Cl. ..... 404/10; 404/15

(58) Field of Search ..... 404/6, 10, 15

(56) References Cited

U.S. PATENT DOCUMENTS

| | | | | |
|---|---|---|---|---|
| 1,624,900 | * | 4/1927 | Parkhurst | 404/6 |
| 1,649,877 | * | 11/1927 | Walston | 404/6 |
| 1,776,447 | * | 9/1930 | Parkhurst | 404/6 |
| 3,389,677 | * | 6/1968 | Dunne | 404/15 |
| 4,367,975 | * | 1/1983 | Tyers | 404/6 |
| 4,974,991 | * | 12/1990 | Mandavi | 404/6 |
| 5,486,065 | * | 1/1996 | James | 404/15 |
| 5,509,753 | * | 4/1996 | Thompson | 404/6 |
| 6,010,277 | * | 1/2000 | Follman | 404/11 |
| 6,024,510 | * | 2/2000 | Kamienchick | 404/15 |

* cited by examiner

*Primary Examiner*—Eileen D. Lillis
*Assistant Examiner*—Gary S. Hartmann
(74) *Attorney, Agent, or Firm*—Gardner Groff Mehrman & Josephic, PC

(57) ABSTRACT

An automatic speed sensitive speed bump having a base plate, a front plate hingedly connected to the base plate, and a torsion spring that biases the front plate upwardly. A rear plate is hingedly connected at its upper end to the front plate. The lower end of the rear plate is beveled and rests on a friction plate, which is hingedly connected at one end to the base plate and is biased upwardly at its other end by a friction plate spring. A strike plate having a reverse beveled end is connected to the base plate. When a vehicle exceeds a predetermined speed, the force of the tires on the front plate causes the rear plate to be driven downwardly rapidly enough and with enough force to depress the friction plate downwardly against the friction plate spring as the lower beveled end of the rear plate is received in the reverse beveled end of the strike plate, which prevents any further rearward movement of the rear plate and therefore locks the speed bump in place. However, when the vehicle is traveling below the predetermined speed, the force on the front plate causes the rear plate to be driven downwardly to a lesser degree and more slowly as the rear plate slides over the friction plate and onto the top surface of the strike plate. In this manner, the front plate and rear plate collapse to a horizontal position such that the vehicle does not experience a bump.

25 Claims, 7 Drawing Sheets

SPEED SENSITIVE AUTOMATIC SPEED BUMP

CROSS-REFERENCE TO RELATED APPLICATION

The present application claims the benefit of priority in four (4) earlier U.S. Provisional Patent Applications, namely application Ser. No. 60/107,029 filed Nov. 4, 1998, Application Ser. No. 60/118,079 filed Jan. 29, 1999, Application Ser. No. 60/126,466 filed on Mar. 26, 1999, and Application Ser. No. 60/126,912 filed on Mar. 29, 1999 each entitled "Speed Sensitive Automatic Speed Bump".

FIELD OF THE INVENTION

The invention relates generally to mechanical devices installed on roadways to slow the speed of motor vehicles, and relates more particularly to an automatic speed bump that is operative based on the speed of the vehicle contacting the bump.

BACKGROUND OF THE INVENTION

In the interest of safety to other vehicles and nearby pedestrians, the speed of motorized vehicles should be kept to a safe level. Excessive vehicular speeds, especially on roads through residential areas and in parking lots, create a dangerous environment for drivers and pedestrians alike. To that end, speed limits are posted on roads, with the local speed limit being dependent on the type of road and the location of the road. Unfortunately, many drivers disregard the posted speed limit.

Other methods, which drivers cannot disregard, are employed on some roads to keep the speed of vehicles at a safe level. It is common for speed bumps to be placed across roads in neighborhoods, parking lots, and other areas where it is desirable to ensure that vehicle speeds are limited. Such speed bumps are usually elongate, mounded areas of asphalt or cement that traverse the width of the road, or the width of a driving area of a parking lot, to ensure that each vehicle encounters the speed bump. The speed bumps are usually painted or physically treated in some manner to alert drivers to the presence of the speed bumps. The dimensions of the speed bumps are such that a vehicle must be slowed to a low speed to pass over the speed bump without jarring the vehicle. Passing over a speed bump at a higher speed, as is known to most drivers, causes a very undesirable jolt to the vehicle and its occupants. In this manner, speed bumps cause drivers to slow down to a low speed to pass over the bump.

Speed bumps are typically installed at intermittent locations along a road or parking lot, but close enough to each other so that vehicles traveling between adjacent speed bumps do not have enough linear road space to accelerate to an unsafe speed, considering the low speed to which the vehicle is slowed to pass over the speed bumps. The speed bumps can be spaced apart any desired distance, which usually depends on the type, shape, and location of the road. For example, speed bumps in a parking lot should be placed relatively close together to drastically limit the speed of vehicles to perhaps 10 mph, but speed bumps on a residential street can be placed further apart to limit the speed of vehicles to perhaps 20 mph or 30 mph. Therefore, speed bumps prevent vehicles from traveling at unsafe speeds along an expanse of a road, in a parking lot, or other driving area.

However, such speed bumps can be very inconvenient and frustrating because they do not discriminate between vehicles driving at different speeds. Speed bumps are installed to require drivers traveling too fast to slow to a low speed to pass over the speed bump. However, drivers that already are traveling at a safe speed do not need the added deterrent of the speed bump to maintain their vehicles at a safe speed. Therefore, although a speed bump is necessary to slow down a fast driver, the speed bump is not necessary, and is a nuisance, for the slower, safer driver who does not exceed the speed limit.

Therefore, speed bumps indiscriminately affect all drivers, even those traveling at a safe speed. This indiscriminate effect on vehicles traveling over speed bumps has caused many people to be opposed to the installation of speed bumps where they are otherwise needed, thereby contributing to an unsafe environment for other drivers on the road and nearby pedestrians.

Therefore, it can be seen that there is a need in the art for an automatic speed bump that is operative based on the speed of the vehicle that contacts the speed bump. There is also a need for an automatic speed bump that provides a bump for vehicles that encounter the speed bump traveling over a predetermined speed, but does not provide a bump for vehicles traveling below the predetermined speed. It is to the provision of such a speed bump that the present invention is primarily directed.

SUMMARY OF THE INVENTION

Briefly described, the present invention comprises a speed bump mounted on top of the pavement or recessed into the pavement. A front pivot member is hingedly connected at its lower end. The front pivot member is biased upwardly such that it is maintained at an inclined position in the absence of an external force acting on it. The front pivot member is hingedly connected at its upper end to a rear pivot member. The rear pivot member has a lower end that rotates about the hinged connection. The lower end of the rear pivot member is urged upwardly by a biasing means. The speed bump further comprises a striker which has a leading edge which can receive the lower end of the rear pivot member.

When a vehicle engages the speed bump at a speed that exceeds a predetermined speed, the impact of the tires on the speed bump causes the rear pivot member to be driven downwardly rapidly enough and with enough force to force the lower end of the rear pivot member beneath the leading edge of the strike plate. The lower end of the rear pivot member is then captured against the leading edge of the strike plate. This prevents any further rearward movement of the rear pivot member, and therefore locks the front pivot member of the speed bump in an inclined position, thus providing a bump to the vehicle traveling above the predetermined speed.

However, when the vehicle is traveling at or below the predetermined speed, the force on the front pivot member causes the rear pivot member to be driven downwardly to a lesser degree and more slowly as the rear pivot member moves toward the strike plate. The lower end of the rear pivot member is not driven down hard enough to be captured by the leading edge of the strike plate. Instead, the rear pivot member slides above and onto the top surface of the strike plate. In this manner, the front and rear pivot members collapse to a horizontal position such that the vehicle does not experience a bump.

Stated another way, in a preferred form the present invention comprises an automatic speed bump for use on a driving surface. The speed bump includes a base element mounted to or recessed in the driving surface and a striker mounted to the base plate and including a leading edge. A front pivot member is hingedly connected to the base plate and is biased toward an inclined, raised position by a spring. A friction element is moveably mounted to the base for movement between a raised position shrouding the leading edge of the striker and a lowered position unshrouding the leading edge of the striker. A friction element biasing means is provided for biasing at least one end of the friction element away from the base. A rear pivot member is provided having an upper end hingedly connected to the front pivot member and having a lower end for slideable engagement with a surface of the friction element. When the vehicle exceeds a predetermined speed and the vehicle's tires contact the speed bump, the impact of the tires on the front pivot member causes the lower end of the rear pivot member to drive the friction element downwardly toward the base to unshroud the leading edge of the striker. This causes the lower end of the rear pivot member to slide off the friction element and to be captured by the leading edge of the striker. This capture of the rear pivot member maintains the front pivot member of the speed bump in its raised, inclined position.

Alternatively, the friction element can be replaced by other means, such as by a roller plate having spring-biased, telescoping rollers mounted thereon. Such a speed bump works essentially the same way as that described above. Namely, when a vehicle engages the speed bump above a predetermined speed, the roller plate becomes engaged with the strike plate and the vehicle experiences a hard bump. When the vehicle engages the speed bump below the predetermined speed, the roller plate smoothly rolls away, flattening the speed bump so that the vehicle does not experience a bump. The predetermined speed can be altered by changing the spring rate, length, and/or pre-load in the springs that bias the telescoping rollers. This arrangement is quieter in use and provides for longer life (due to rolling contact, rather than sliding contact).

The present invention addresses the need in the art by providing a speed bump that automatically discriminates between vehicles traveling at different speeds. The invention does so by providing a bump to vehicles traveling above the predetermined speed, while not providing a bump to those vehicles traveling below the predetermined speed. The speed bump of the present invention is rugged, has few moving parts, and provides an inexpensive way to mechanically provide automatic operation of a speed bump based solely on the speed of a vehicle.

Accordingly, it is an object of the present invention to provide an automatic speed bump that is operative based on the speed of the vehicle that contacts the bump.

It is another object of the present invention to provide an automatic speed bump that provides a bump for vehicles traveling above a predetermined speed, but does not provide a bump for vehicles traveling below the predetermined speed.

It is another object of the present invention to provide an automatic speed bump that can be inexpensively constructed to mechanically provide automatic operation of a speed bump based on the speed of a vehicle.

These and other objects, advantages, and features of the present invention will become apparent upon reading the following specification in conjunction with the accompanying drawing figures.

DETAILED DESCRIPTION OF THE PREFERRED EMBODIMENT

Figure 1:
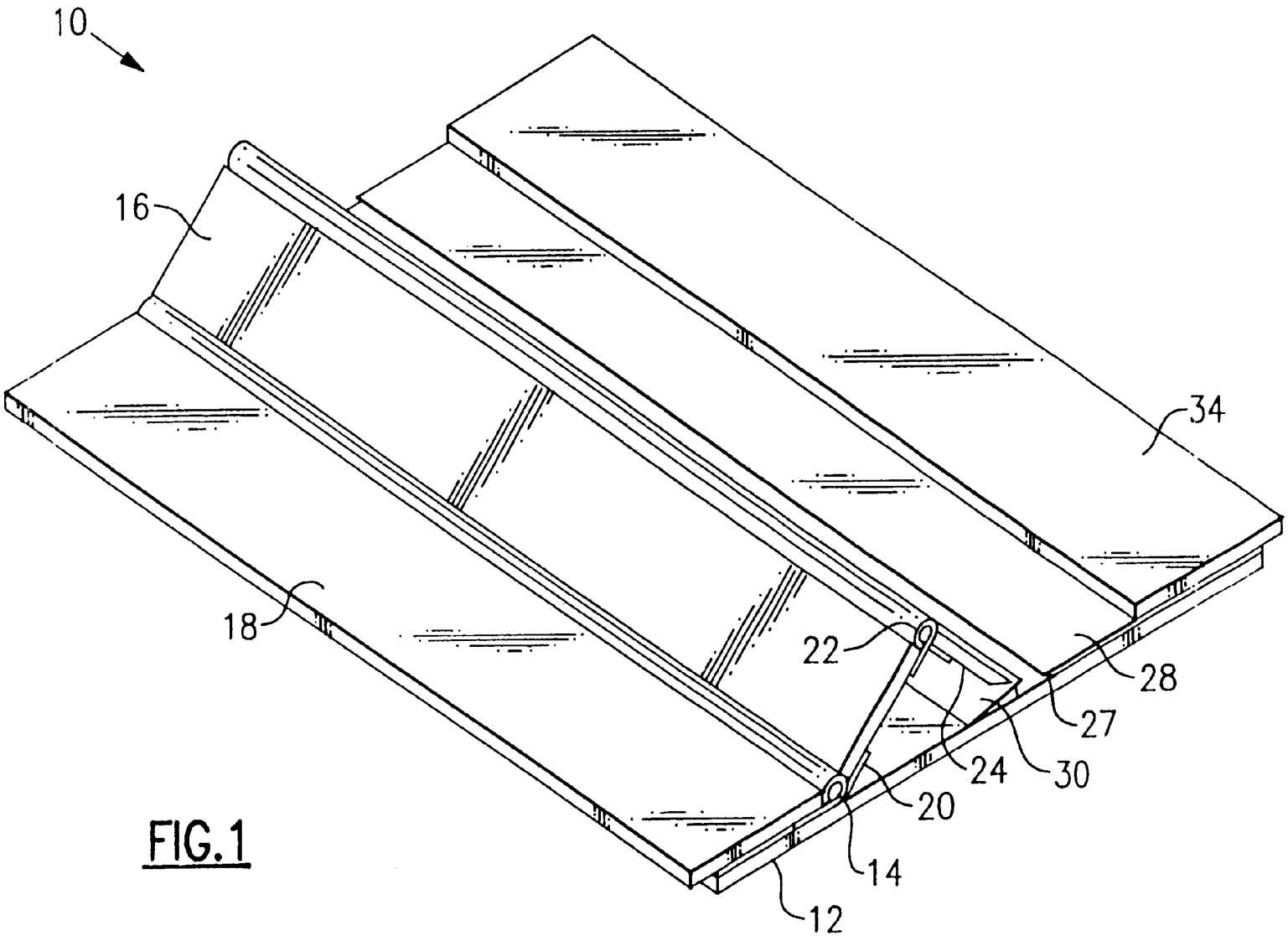
FIG. 1 is a perspective illustration of a speed bump according to a preferred form of the present invention.
Figure 2:
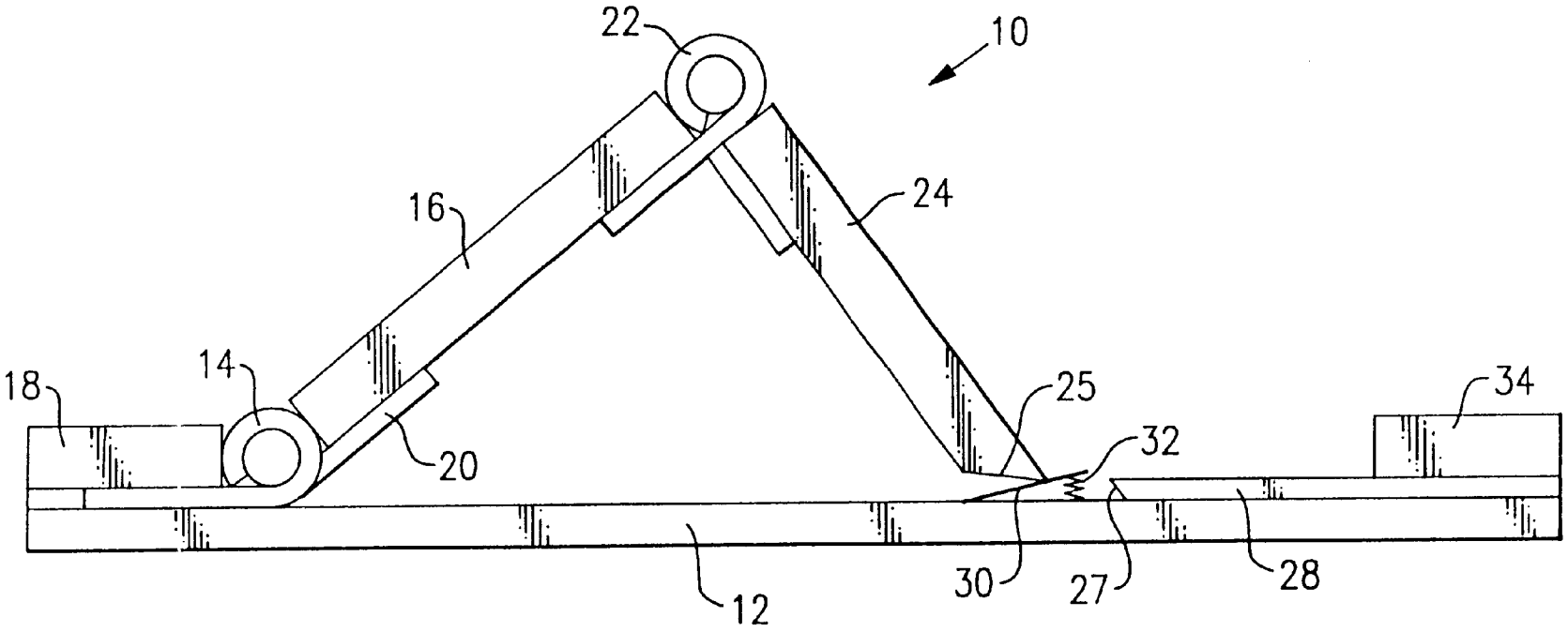
FIG. 2 is a side view of the speed bump of FIG. 1.

Referring now to the drawing figures, wherein like reference numerals represent like parts throughout the several views, FIGS. 1 and 2 show an illustrative embodiment of the speed bump of the present invention, represented by general reference numeral 10. The speed bump 10 includes a base plate 12 that can be mounted on top of the pavement or recessed into the pavement. A bottom hinge 14 is connected to the base plate 12 and a lower end of a front plate 16. In this manner, the front plate is hingedly connected to the base plate. A leading horizontal plate 18 is connected to base plate in front of the front plate to create an even surface for vehicles tires when approaching the speed bump.

A spring means, such as torsion spring 20, biases the front plate upwardly such that it is maintained at a predetermined angle in the absence of any force acting on the front plate. This angle is approximately 45 degrees, but other angles can be suitable. It will be understood that the speed bump typically is to be installed in the driving surface such that the tire of an approaching vehicle first rolls over the leading horizontal plate and then contacts the inclined front plate.

A top hinge 22 is connected between the upper end of the front plate and the upper end of a rear plate 24 such that the front and rear plates are hingedly connected to each other. Note that no torsion spring or other means is needed for urging the rear plate toward or away from the front plate. Thus, the rear plate is able to rotate freely about the top hinge relative to the front plate. However, the rotation of the rear plate toward the front plate is limited by a friction plate, as will be described below.

The lower end 25 of the rear plate is beveled such that it can be received in a recess formed by a reverse beveled end 27 of strike plate 28. The striker or strike plate 28 and an upper surface of base plate 12 are connected to the base plate 12 to position the leading edge of bevel 27 at a predetermined distance from the bottom hinge 14. The predetermined distance at which the strike plate is located is such that when the lower end of the rear plate is received against the strike plate, the front plate is maintained at an inclined position. Changing the location of the strike plate changes the inclination of the front plate when the speed bump is locked in position, as described below.

The beveled end of the rear plate rests on a friction plate 30, but is not attached or connected to the friction plate, so it is slidable across the upper surface of the friction plate. One end of the friction plate 30 is hingedly connected to the base plate and the other end, near the strike plate, is urged upwardly by a friction plate spring 32, shown in FIG. 2 as a coil spring. It will be understood that the friction plate may be urged upwardly not only by a coil spring, but by any suitable biasing means. A trailing horizontal plate 34 is connected on top of the strike plate to create a level surface for the tires of a vehicle when the rear plate slides over the strike plate to a substantially flat, horizontal position.

In operation, as shown in FIGS. 3 and 4, a wheel of a vehicle advances over the leading horizontal plate 18 and contacts the front plate 16. The overall height of the speed bump is typically no more than about 12 inches, so that the tires of a typical vehicle are usually at least twice the height of the speed bump. As the tire contacts the front plate, the front plate is forced into a clockwise rotation about the bottom hinge. This, in turn, causes the rear plate to be rotated slightly counterclockwise about the top hinge. In this way, the lower beveled end of the rear plate slides over the friction plate in a direction toward the strike plate.

It should be understood that a vehicle traveling at a high speed will impact the front plate of the speed bump more forcefully than will a vehicle traveling at a slower speed. Therefore, the spring rates and sizes of the torsion spring and the friction plate spring are chosen to set the speed bump to operate at a predetermined speed. For example, if the speed bump is installed on a road with a speed limit of 30 mph, then the springs should be chosen much firmer than those for a speed bump installed in a parking lot where the speed of vehicles contacting the speed bump is typically much lower.

Figure 3A:
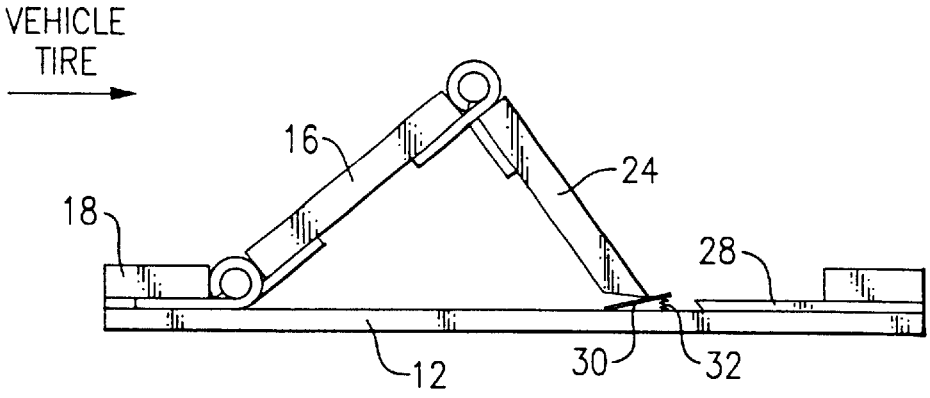
FIGS. 3A–C demonstrate how the speed bump of FIG. 1 locks in an inclined position to provide a bump for a vehicle traveling above a predetermined speed as the vehicle passes over the speed bump.
Figure 3B:
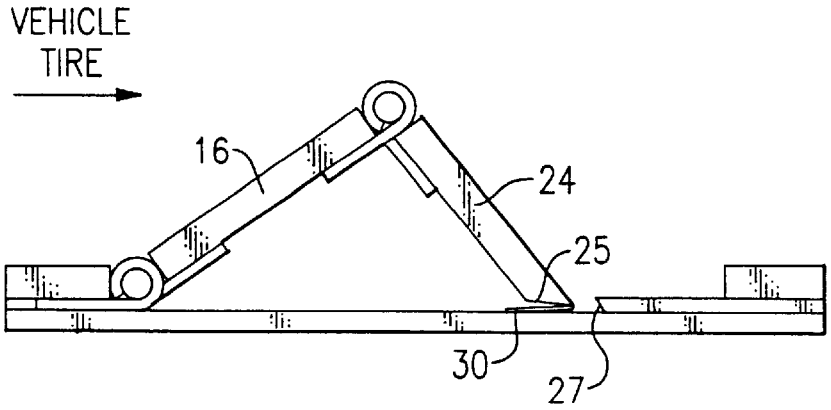
Figure 3C:
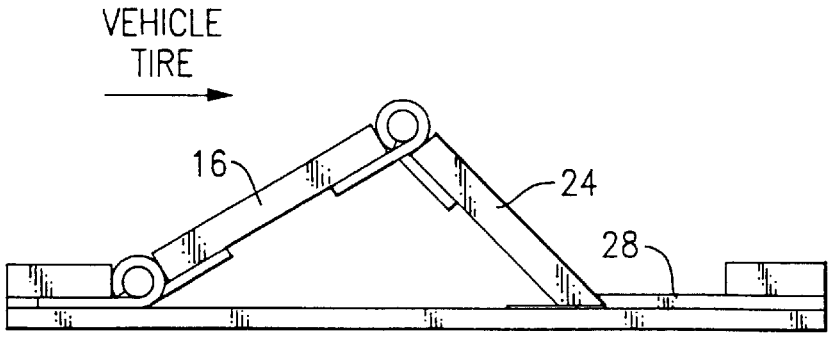
Figure 4A:
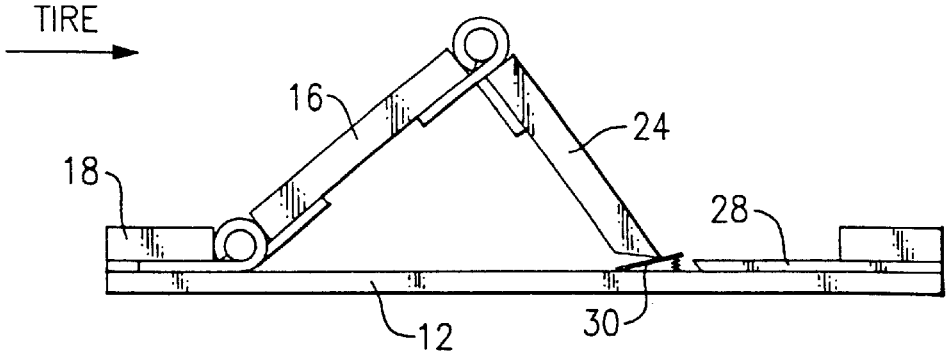
FIGS. 4A–E demonstrate how the speed bump of FIG. 1 collapses to a horizontal position for a vehicle traveling below a predetermined speed as the vehicle passes over the speed bump.
Figure 4B:
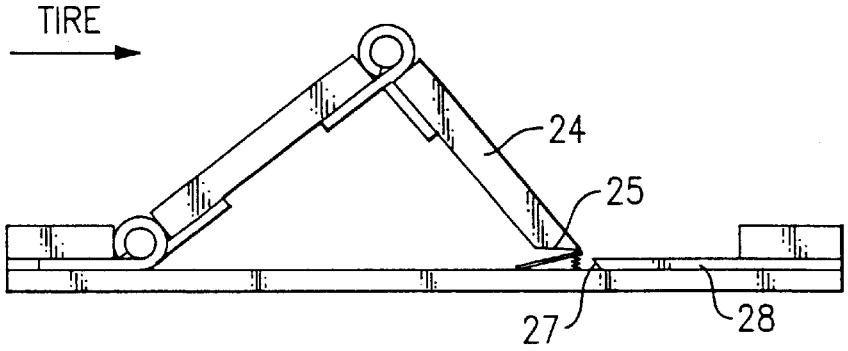
Figure 4C:
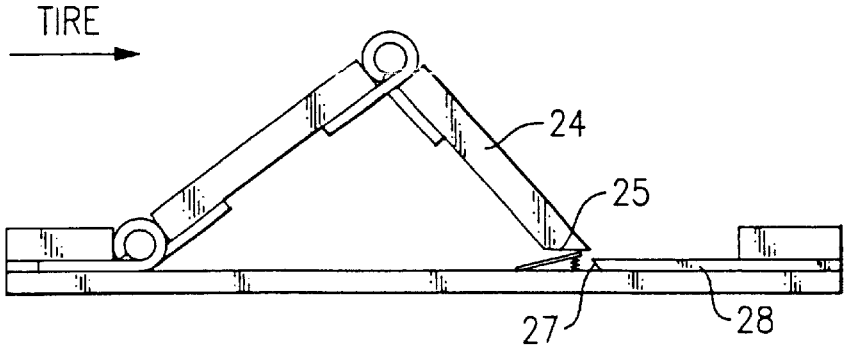
Figure 4D:
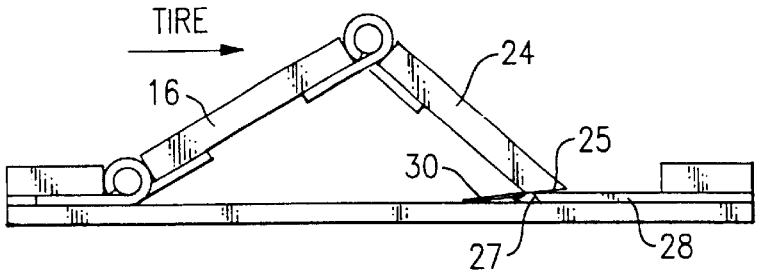
Figure 4E:
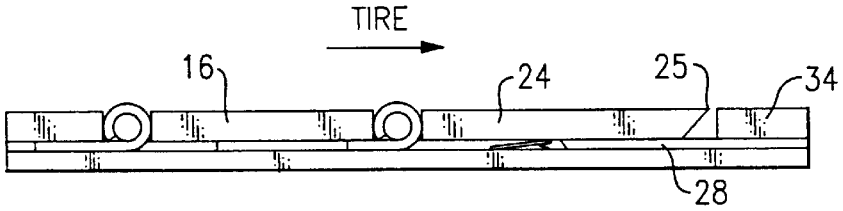

In this manner, the speed bump of the present invention can be set to operate at a predetermined speed. As shown in FIGS. 3A–C, when a vehicle exceeds a predetermined speed, the force of the tires impacting on the front plate causes the rear plate to be driven downwardly rapidly enough and with enough force to depress the friction plate downwardly against the friction plate spring such that the beveled end of the rear plate moves downwardly and is received against the reverse beveled end of the strike plate. In FIG. 3A, the tire of the vehicle first contacts the front plate. In FIG. 3B, the force of the tire on the front plate causes the rear plate to be driven downwardly to depress the friction plate against the friction plate spring. At the same time, the beveled end of the rear plate slides rearwardly on the friction plate toward the strike plate. Because the tire imparts enough force to cause the rear plate to depress the friction plate quickly as the rear plate slides on the friction plate, and before the rear plate slides completely off of the friction plate, the beveled edge of the rear plate is received in the reverse beveled end of the strike plate, as shown in FIG. 3C. This prevents any further rearward movement of the rear plate, and therefore locks the speed bump in place, as shown in FIG. 3C. Thus, if the vehicle's speed exceeds the predetermined speed, which may be set to equal the speed limit or other acceptable speed, then the front plate of the speed bump remains inclined and the vehicle experiences a hard bump. After the vehicle passes over the speed bump, the speed bump returns to the position shown in FIG. 3A because the absence of force on the front plate allows the torsion spring to urge the front plate upwardly to an inclined position, and the friction plate spring biases the friction plate upwardly, with the beveled end of the rear plate resting on the friction plate. However, if the vehicle's speed is less than the predetermined speed, then the speed bump collapses such that the front and rear plates become essentially horizontal, as shown in FIGS. 4A–E. In FIG. 4A, the tire of the vehicle contacts the front plate. If the vehicle is traveling below the predetermined speed, as determined by the spring rates and sizes of the torsion spring and friction plate spring, the lesser force imparted by the tires of the slower moving vehicle on the front plate causes the rear plate to drive the friction plate downwardly against the friction plate spring to a lesser degree and more slowly than for a faster vehicle, as shown in FIG. 4B. At the same time, the rear plate slides on the friction plate toward the strike plate. Because the impact of the tires does not impart enough force to cause the rear plate to depress the friction plate against the friction plate spring far enough and fast enough, the rear plate slides over the friction plate but does not engage the reverse beveled end of the strike plate, as shown in FIG. 4C. Instead, the rear plate slides off of the friction plate and onto the top surface of the strike plate, as shown in FIG. 4D. As the tires travels over the speed bump, the rearward movement of the rear plate is not obstructed, and the front plate and rear plate collapse to a horizontal position, as shown in FIG. 4E. In this manner, the vehicle traveling below the predetermined speed does not experience a bump. After the vehicle passes over the rear plate, the speed bump returns to the position shown in FIG. 4A because the absence of force on the rear plate allows the torsion spring to urge the front plate upwardly to an inclined position, and the beveled end of the rear plate returns to rest on the friction plate, which is biased upwardly by the friction plate spring.

Figure 5:
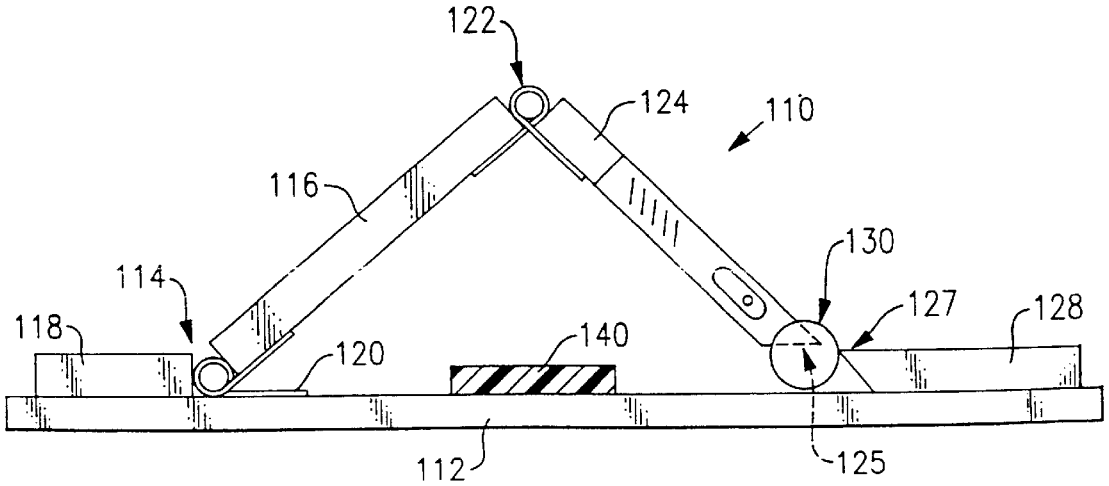
FIG. 5 is a side view of a speed bump according to a modified form of the present invention.
Figure 6:
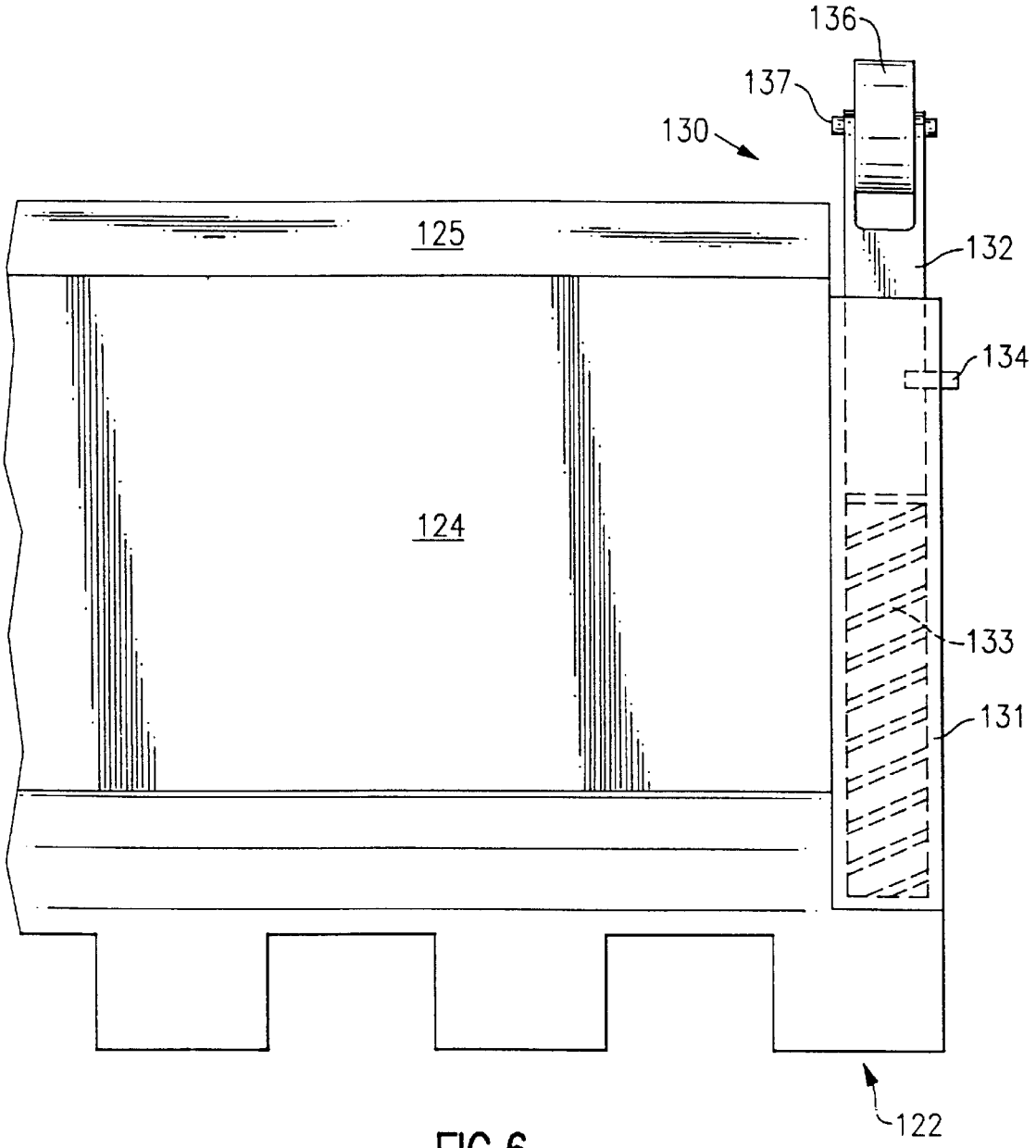
FIG. 6 is a bottom view of a portion of the speed bump of FIG. 5.
Figure 7:
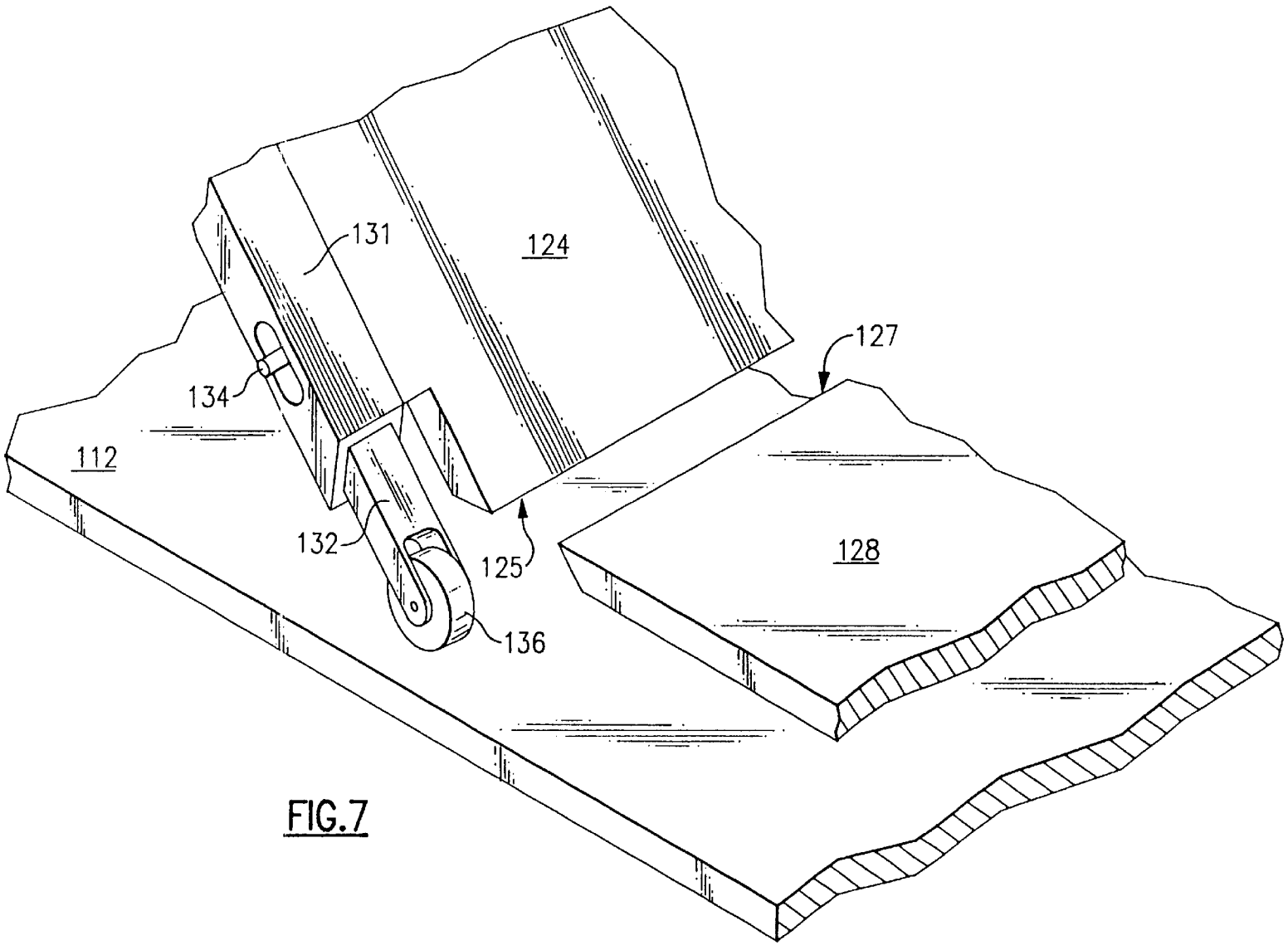
FIG. 7 is a perspective illustration of a portion of the speed bump of FIG. 5.

FIGS. 5–7 show the speed bump of the present invention in a second preferred form, represented by general reference numeral 110. The speed bump 110 includes a base plate 112 that can be mounted on top of the pavement or recessed into the pavement. A piano hinge 114 is connected to the base plate 112 and to a lower end of a front plate 116. In this manner, the front plate is hingedly connected to the base plate. A leading horizontal plate 118 is connected to base plate in front of the front plate to create an even surface for vehicles tires when approaching the speed bump.

A spring means, such as torsion spring 120, biases the front plate upwardly such that it is maintained at a predetermined angle in the absence of any force acting on the front plate. A top piano hinge 122 connects the upper end of the front plate 116 and the upper end of a rear plate or rear pivot member 124 such that the front and rear plates are hingedly connected to each other. Note that no torsion spring or other means is needed for urging the rear plate toward or away from the front plate. Thus, the rear plate is able to rotate freely about the top hinge relative to the front plate.

The central section of a lower end of the rear plate includes a beveled edge 125 such that it can be received in a recess formed by a reverse beveled end 127 of strike plate 128. The striker or strike plate 128 is connected to the base plate 112 to position the leading edge or bevel 127 at a predetermined distance from the bottom hinge 114. The predetermined distance at which the strike plate is located is such that when the lower end of the rear plate is received against the strike plate, the front plate is maintained at an inclined position. Changing the location of the strike plate changes the inclination of the front plate when the speed bump is locked in position.

The beveled end of the rear plate is supported over the base plate 112 by a pair of outboard rollers, such as roller 130. As best seen in FIG. 6 and FIG. 7, the outboard roller 130 is welded to an edge of the rear plate 124 and includes a fork housing 131 telescopically receiving a telescoping fork 132. The telescoping fork 132 is urged outwardly by a compression spring 133, with the outward movement thereof limited by a limit pin 134. The telescoping fork 132 straddles a rotatable wheel 136 rotatably mounted to the fork 132 by an axle 137.

As seen in the figures, the telescoping fork 132 extends in the same plane as that of the rear plate 124. This provides a simple, compact arrangement. However, it is possible to reorient the telescoping roller so that the relative movement is not in the same plane as the rear plate, although at the expense of some additional complexity and loss of some compactness.

The roller 130 extends beyond the beveled edge 125 of the rear plate 124. In this way, the roller supports the beveled edge above the base plate 112. The outboard roller is configured to support the beveled edge 125 a distance above the base plate 112 slightly greater than the height of the striker 128.

As seen in FIG. 6, the upper hinge 122 is in the form of a piano hinge, with FIG. 6 showing the alternating hinge sections of the rear plate 124. Those skilled in the art will recognize that the front plate has complementary hinge sections and a hinge pin is driven through these hinge sections when co-aligned.

To minimize noise and to reduce mechanical shock in use, a rubber snubber 140 is mounted atop the base plate 112 half-way between the front piano hinge 114 and the striker 128. In this way, as the front plate and the rear plate are driven downwardly toward the base plate, the rubber snubber operates to absorb some mechanical shock and to reduce noise that would otherwise occur as the front and rear plate impact the base plate.

The present invention has several advantages not found in the prior art. For example, the invention provides a speed bump that is automatically speed sensitive to collapse to a horizontal position to allow vehicles operating below a predetermined speed to drive over the speed bump without a bump. However, the speed sensitive speed bump also locks in an inclined, upright position to provide a bump for vehicles traveling above the predetermined speed. In this manner, the novel speed bump mechanically discriminates between slower vehicles and faster vehicles, relative to a predetermined speed, and does not provide a frustrating bump to those vehicles that are traveling below the predetermined speed, which do not need to be encouraged to slow down. Furthermore, the speed bump of the present invention is rugged, has few moving parts, and provides an inexpensive way to mechanically provide automatic operation of a speed bump based on the speed of a vehicle going over the speed bump.

While the invention has been disclosed in preferred forms, it will be apparent to those skilled in the art that many modifications, additions, and deletions may be made therein without departing from the spirit and scope of the invention as set forth in the following claims.

What is claimed is:

1. An automatic speed bump for use on a driving surface, comprising:

a base mounted to the driving surface;

a striker mounted to said base and including a leading edge;

a front pivot member hingedly connected to said base;

a spring means for biasing said front pivot member toward an inclined, raised position;

a friction element movably mounted to said base for movement between a first raised position shrouding said leading edge and a second lowered position unshrouding said leading edge;

a friction element biasing spring means for biasing at least one end of said friction element away from said base;

a rear pivot member having an upper end hingedly connected to said front pivot member, and having a lower end for slidable engagement with a surface of said friction element;

wherein when a vehicle exceeds a predetermined speed, and the vehicle's tires contact the speed bump, the force of the tires on said front pivot member causes said lower end of said rear pivot member to drive said friction element downwardly toward said base to unshroud said leading edge of said striker, and causes said lower end of said rear pivot member to slide off of said friction element and be captured by said leading edge of said striker, thereby maintaining said front pivot member of the speed bump in an inclined position.

2. An automatic speed bump as claimed in claim 1 wherein when a vehicle is traveling below said predetermined speed, the force of the tires on said front pivot member causes said lower end of said rear pivot member to slide off of said friction element without unshrouding said leading edge of said striker, thereby allowing said front pivot member and rear pivot member to collapse to a substantially flat, horizontal configuration.

3. An automatic speed bump as claimed in claim 1 wherein said lower end of said rear pivot member is beveled.

4. An automatic speed bump as claimed in claim 1 wherein said leading edge of said striker is beveled.

5. An automatic speed bump as claimed in claim 1 wherein a trailing edge of said friction element is biased toward a position slightly above said leading edge of said striker.

6. An automatic speed bump as claimed in claim 1 wherein said spring means for biasing said front pivot member toward an inclined position comprises a torsion spring.

7. An automatic speed bump as claimed in claim 1 wherein said friction element biasing means comprises a coil spring.

8. An automatic speed bump as claimed in claim 1 wherein said spring means and said friction element biasing means are sized and selected such that said lower end of said rear pivot member is received against said leading edge of said striker when a vehicle contacts said speed bump in excess of a predetermined speed, but said lower end of said rear pivot member slides over and onto an upper surface of said striker when a vehicle contacts said speed bump below said predetermined speed.

9. An automatic speed bump as claimed in claim 1 wherein said front pivot member comprises a plate and wherein said rear pivot member comprises a plate.

10. An automatic speed bump as claimed in claim 1 wherein said friction element comprises a plate pivotally mounted to said base.

11. An automatic speed bump for use on a driving surface, comprising:

a base mounted to the driving surface;

a striker mounted to said base and including a leading edge;

a front pivot member hingedly connected to said base;

a spring means for biasing said front pivot member toward an inclined, raised position;

a rear pivot member having an upper end hingedly connected to said front pivot member, and having mounted thereon at least one roller mounted thereto, said at least one roller being biased toward extending from said rear pivot member for supporting a lower edge of said rear pivot member above said striker;

wherein when a vehicle exceeds a predetermined speed, and the vehicle's tires contact the speed bump, the force of the tires on said front pivot member causes said at least one roller to retract, thereby lowering said lower edge of said rear pivot member, causing said lower edge of said rear pivot member to be captured by said leading edge of said striker, thereby maintaining said front pivot member of the speed bump in an inclined position.

12. An automatic speed bump as claimed in claim 11 wherein when a vehicle is traveling below said predetermined speed, the force of the tires on said front pivot member is insufficient to cause said lower edge of said rear pivot member to move beneath said leading edge of said striker, thereby allowing said front pivot member and rear pivot member to collapse to a substantially flat, horizontal configuration.

13. An automatic speed bump as claimed in claim 11 wherein said lower edge of said rear pivot member is beveled.

14. An automatic speed bump as claimed in claim 11 wherein said leading edge of said striker is beveled.

15. An automatic speed bump as claimed in claim 11 wherein said lower edge of said rear pivot member is biased toward a position slightly above said leading edge of said striker.

16. An automatic speed bump as claimed in claim 11 wherein said spring means for biasing said front pivot member toward an inclined position comprises a torsion spring.

17. An automatic speed bump as claimed in claim 11 further comprising a coil spring for biasing said at least one roller.

18. An automatic speed bump as claimed in claim 17 wherein said spring means and said coil spring are sized and selected such that said lower edge of said rear pivot member is received against said leading edge of said striker when a vehicle contacts said speed bump in excess of a predetermined speed, but said lower edge of said rear pivot member slides over an upper surface of said striker when a vehicle contacts said speed bump below said predetermined speed.

19. An automatic speed bump as claimed in claim 11 wherein said front pivot member comprises a plate and wherein said rear pivot member comprises a plate.

20. An automatic speed bump for use on a driving surface, comprising:

a base mounted to the driving surface;

a striker mounted to said base and including a leading edge;

a front pivot member hingedly connected at a lower end to said base;

first biasing means for biasing said front pivot member upwardly;

a rear pivot member hingedly connected at its upper end to an upper end of said front pivot member, said rear pivot member having a lower end;

second biasing means for biasing the lower end of said rear pivot member upwardly toward a position above said leading edge of said striker; and wherein said biasing means are sized and adapted such that wherein when a vehicle engages the speed bump at a speed that exceeds a pre-determined speed, the impact of the vehicle on the speed bump causes the rear pivot member to be driven downwardly rapidly enough and with enough force to move the lower end of the rear pivot member beneath the leading edge of the strike plate, capturing the rear pivot member against the strike plate, thereby providing a hard bump to the vehicle traveling above the pre-determined speed, and wherein when a vehicle is traveling at or below the pre-determined speed, the impact of the vehicle on the front pivot member causes the rear pivot member to be driven downwardly less forcefully and more slowly as the rear pivot member moves toward the strike plate, thereby allowing the rear pivot member to slide over the strike plate and causing the front rear pivot members to flatten out whereby no bump is presented to the vehicle.

21. An automatic speed bump as claimed in claim 20 wherein said second biasing means comprises a friction element movably mounted to said base for movement between a first raised position shrouding said leading edge and a second lowered position unshrouding said leading edge and a friction element biasing spring means for biasing at least one end of said friction element away from said base.

22. An automatic speed bump as claimed in claim 21 wherein said lower end of said rear pivot member is beveled.

23. An automatic speed bump as claimed in claim 21 wherein said leading edge of said striker is beveled.

24. An automatic speed bump as claimed in claim 20 wherein said second biasing means comprises at least one roller mounted to said rear pivot member, said at least one roller being biased toward extending from said rear pivot member for supporting a lower edge of said rear pivot member above said striker.

25. An automatic speed bump as claimed in claim 24 further comprising a coil spring for biasing said at least one roller.

* * * * *